US006597130B2

(12) United States Patent
Lee et al.

(10) Patent No.: US 6,597,130 B2
(45) Date of Patent: Jul. 22, 2003

(54) DRIVING APPARATUS OF DISCHARGE TUBE LAMP

(75) Inventors: Seok Woo Lee, Seoul (KR); Seung Man Gu, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/139,371

(22) Filed: May 7, 2002

(65) Prior Publication Data

US 2003/0071584 A1 Apr. 17, 2003

(30) Foreign Application Priority Data

Oct. 13, 2001 (KR) ..... P2001-63206
Oct. 29, 2001 (KR) ..... P2001-66631

(51) Int. Cl.[7] ..... G05F 1/00

(52) U.S. Cl. ..... 315/294; 315/291; 315/278; 315/224; 315/318; 315/325

(58) Field of Search ..... 315/291, 224, 315/276, 278, 225, 244, 312, 318, 324, 315, 294, 307, 325

(56) References Cited

U.S. PATENT DOCUMENTS 6,144,170 A * 11/2000 Beland et al. ..... 315/276
6,181,086 B1 * 1/2001 Katyl et al. ..... 315/307

* cited by examiner

*Primary Examiner*—Haissa Philogene
(74) *Attorney, Agent, or Firm*—Morgan, Lewis & Bockius LLP

(57) ABSTRACT

A driving apparatus of a discharge tube lamp includes a voltage source; a plurality of AC conversion circuits for boosting a voltage supplied from the voltage source and generating a plurality of boosted AC signals; a plurality of discharge tubes for receiving the boosted AC signals and emitting a plurality of lights; a plurality of detection circuits arranged between each of the plurality of AC conversion circuits and a ground voltage source for detecting a voltage supplied to each of the plurality of discharge tubes; and a controller arranged between the voltage source and each of the plurality of the AC conversion circuits for controlling the voltage supplied to the plurality of AC conversion circuits in accordance with a plurality of detection signals supplied from the plurality of detection circuits.

7 Claims, 7 Drawing Sheets

DRIVING APPARATUS OF DISCHARGE TUBE LAMP

This present invention claims the benefit of Korean Patent Application No. P2001-63206 filed in Korea on Oct. 13, 2001 and of Korean Patent Application No. P2001-66631 filed in Korea on Oct. 29, 2001, which are both hereby incorporated by reference.

BACKGROUND OF THE INVENTION

1. Field of the Invention

The present invention relates to a driving apparatus of a discharge tube lamp, and more particularly, to a driving apparatus of a discharge tube lamp that is capable of, when using a plurality of discharge tubes, controlling each of the electric currents supplied to each of the plurality of discharge tubes even though a ground level is used commonly, thereby reducing the brightness deviation.

2. Discussion of the Related Art

In recent years, there has been a general trend to broaden the scope of the applications of liquid crystal displays (LCDs) by improving characteristics such as, for example, the weight and size of LCDs and the power consumption required to drive LCDs. As a result of these improvements, LCDs are now used in such applications as office automation equipment and audio/video equipment. LCDs control the amount of a transmitted light beam in accordance with a video signal applied to a plurality of control switches that are arranged in a matrix.

Because LCDs are not a self light-emitting display devices, they require light sources such as back lights. A cold cathode fluorescent tube (CCFL) is used as a light source in the back light. A CCFL is a light source tube that utilizes cold emission, which is an electron emission caused by a strong electric field applied to the surface of a cathode cold emission has the advantages of low heat emission, high brightness, long life and full color. CCFLs can be classified into light guide systems, direct illumination systems and reflection plate systems. A proper light source tube is used in accordance with the need of the particular LCD.

A CCFL uses an inverter circuit to obtain a high voltage power in a direct current power of a low voltage.

Referring to FIGS. 1 and 2, a conventional driving apparatus includes a voltage source Vin. A first CCFL 100, a second CCFL 110 and a third CCFL 120 emit light by an AC signal. A first resonance type inverter circuit 20, a second resonance type inverter circuit 30 and a third resonance type inverter circuit 40 are each mounted between the voltage source Vin and the first to third CCFLs 100, 110 and 120 for supplying the AC signal to the first to third CCFLs 100, 110 and 120. A first wire transformer T1, a second wire transformer T2 and a third wire transformer T3 each boost the voltage supplied from the voltage source Vin and supply the boosted AC signal to the first to third CCFLs 100, 110 and 120. A voltage detector 50 is commonly connected to the first to third CCFLs 100, 110 and 120 and connected to the first to third resonance type inverter circuits 20, 30 and 40 for detecting the voltage commonly supplied to the first to third CCFLs 100, 110 and 120.

One terminal of each of the first to third CCFLs 100, 110 and 120 is connected to the first to third wire transformer T1, T2 and T3, respectively. The other terminal of each of the first to third CCFLs 100, 110 and 120 is commonly connected to the voltage detector 50. Each of the first to third CCFLs 100, 110 and 120 receives the boosted AC signals from the first to third wire transformers T1, T2 and T3 to emit light.

Each of the first to third wire transformers T1, T2 and T3 consists of a primary coil L1, a secondary coil L2 and an auxiliary coil L3. Each of the primary coil L1 and the auxiliary coil L3 is connected to a radio frequency oscillation circuit 25. One terminal of the secondary coil L2 is connected to one terminal of each of the first to third CCFLs 100, 110 and 120 through a first capacitor C1, and another terminal of the secondary coil is connected to a ground voltage source GND.

In the description that follows, only the first resonance type inverter circuit 20 is described because each of the first to third resonance type inverter circuits 20, 30 and 40 has the same circuit configuration.

The first resonance type inverter circuit 20 includes a radio frequency oscillation circuit 25 connected to the primary coil L1 of the first wire transformer T1. A first transistor Q1 is connected between the radio frequency oscillation circuit 25 and the voltage source Vin for switching the voltage from the voltage source Vin to the radio frequency oscillation circuit 25. A pulse width modulation (PWM) controller 24 supplies control signals to the first transistor Q1. A power switch 26 is connected between the PWM controller 24 and the voltage source Vin. A brightness controller 22 supplies a brightness control signal to the PWM controller 24 in accordance with the detected voltage signal FB supplied from the voltage detector 50.

The radio frequency oscillation circuit 25 includes a second transistor Q2 and a third transistor Q3 having the ground voltage source GND in between and connected to the primary coil L1 of the first wire transformer T1. A second capacitor C2 is arranged parallel to the primary coil L1.

The collector terminals of the second transistor Q2 and the third transistor Q3 are respectively connected to both sides of the primary coil L1 of the first wire transformer T1. The emitter terminals of the second and third transistors Q2 and Q3 are commonly connected to the ground voltage source GND. The middle point of the primary coil L1 is connected to the base terminals of the second and third transistors Q2 and Q3 through a first resistance RI and a second resistance R2, and is connected to both sides of the auxiliary coil L3.

The second and third transistors Q2 and Q3 are alternately switched to store at the second capacitor C2 the voltage supplied through the first transistor Q1.

Referring to FIG. 3, the voltage detector 50 includes a third resistance R3 and a variable resistance RB serially connected between the ground voltage source GND and a first node N1 that is commonly connected to the first to third CCFLs 100, 110 and 120. A second diode D2 is arranged between the first node N1 and the ground voltage source GND. A third diode D3 is arranged between the first node N1 and the brightness controller 22.

The third resistance R3 and the variable resistance RB detects by their own resistance values the voltage supplied to the first to third CCFLs 100, 110 and 120 to have the detected voltage signal on the first node N1. The detected voltage signal FB on the first node N1 is supplied to the brightness controller 22 through the third diode D3. The second diode D2 shuts out the impulse of a negative potential to sustain the lowest potential of the detected voltage signal FB at zero potential.

The voltage detector 50 is commonly connected to the first to third CCFLs 100, 110 and 120, and detects an AC high voltage commonly supplied to the first to third CCFLs 100, 110 and 120.

The brightness controller 22 generates a brightness control signal by using a brightness duty ratio signal B-duty or a reference brightness signal B-dc supplied from the outside and the detected voltage signal FB supplied from the voltage detector 50, and supplies the brightness control signal to the PWM controller 24. The brightness duty ratio signal B-duty and the reference brightness signal B-dc may be supplied by a system engineer or a user.

PWM controller 24 receives the brightness control signal from the brightness controller 22 and supplies a PWM control signal to the base terminal of the first transistor Q1 when the power switch is turned on. The PWM control signal controls the switching cycle of the first transistor Q1 in accordance with the brightness control signal, thereby controlling the voltage supplied to the first wire transformer T1.

The first transistor Q1 is turned on by the PWM control signal supplied from the PWM controller 24 to switch to the radio frequency oscillation circuit 25 the voltage supplied from the voltage source Vin. A coil is connected between the collector terminal of the first transistor Q1 and the radio frequency oscillation circuit 25, and the first diode D1 is connected between the collector terminal of the first transistor Q1 and the ground voltage source GND.

The coil prevents switching damage of the first transistor Q1 and determines a resonance frequency for a self-resonance with a radio frequency oscillation circuit 25. The first diode D1 sustains the lowest potential of the collector terminal of the first transistor Q1 at zero potential. In other words, the first diode D1 shuts out the impulse of the negative potential generated when turning off the first transistor Q1.

In such a conventional CCFL driving apparatus, when the power switch 26 is turned on, the first transistor Q1 is turned on by the PWM control signal from the PWM controller 24 to supply driving power to the radio frequency oscillation circuit 25. At this moment, in the second and third transistors Q2 and Q3, turn-on/turn-off and turn-off/turn-on operations are carried out in accordance with the size of the voltage charged at the second capacitor C2 to induce an AC high voltage at the secondary coil L2 of the first wire transformer T1.

Thus, the induced AC high voltage from the secondary coil L2 of the first wire transformer T1 induces an AC high voltage at the auxiliary coil L3. Due to this, the second and third transistor Q2 and Q3 are repeatedly switched to continuously induce the AC high voltage at the secondary coil L2 of the first wire transformer T1.

Therefore, the AC high voltage generated at the first wire transformer T1 is supplied to the first CCFL 100 to turn on the first CCFL 100. Also, the second and third CCFLs 110 and 120 are turned on by the AC high voltage generated by the second and third wire transformers T2 and T3.

In this way, when the first to third CCFLs 100, 110 and 120 are turned on, the integrated voltage signal FB supplied to the first to third CCFLs 100, 110 and 120 is detected by the voltage detector 50 commonly connected to the first to third CCFLs 100, 110 and 120. The detected voltage signal FB is applied to the brightness controller, and a brightness control signal is generated for controlling the brightness of the first to third CCFLs 100, 110 and 120 by using the detected voltage signal FB in the brightness controller 22. The PWM controller 24 controls the electric current commonly supplied to the first to third CCFLs 100, 110 and 120 in accordance with the generated brightness control signal.

However, the conventional CCFL driving apparatus has difficulty controlling the brightness of each of the first to third CCFLs 100, 110 and 120. This is because the first to third CCFLs 100, 110 and 120 cannot be controlled independently since one terminal of the first to third CCFLs 100, 110 and 120 is commonly connected. Accordingly, brightness deviations of a plurality of CCFL lamps occur. Thereby, the life of a plurality of cold cathode fluorescent tubes gets shortened.

SUMMARY OF THE INVENTION

Accordingly, the present invention is directed to a driving apparatus of a discharge tube lamp that substantially obviates one or more of the problems due to limitations and disadvantages of the related art.

An object of the present invention is to provide a driving apparatus of a discharge tube lamp that is capable of, when using a plurality of discharge tubes, controlling each of electric currents supplied to each of the plurality of discharge tubes even though a ground level is used commonly, thereby reducing its brightness deviation.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the driving apparatus of a discharge tube lamp includes a voltage source; a plurality of AC conversion circuits for boosting a voltage supplied from the voltage source and generating a plurality of boosted AC signals; a plurality of discharge tubes for receiving the boosted AC signals and emitting a plurality of lights; a plurality of detection circuits arranged between each of the plurality of AC conversion circuits and a ground voltage source for detecting a voltage supplied to each of the plurality of discharge tubes; and a controller arranged between the voltage source and each of the plurality of the AC conversion circuits for controlling the voltage supplied to the plurality of AC conversion circuits in accordance with a plurality of detection signals supplied from the plurality of detection circuits.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

With reference to FIGS. 4 to 8B, a preferred embodiment of the present invention is explained as follows.

Figure 1:
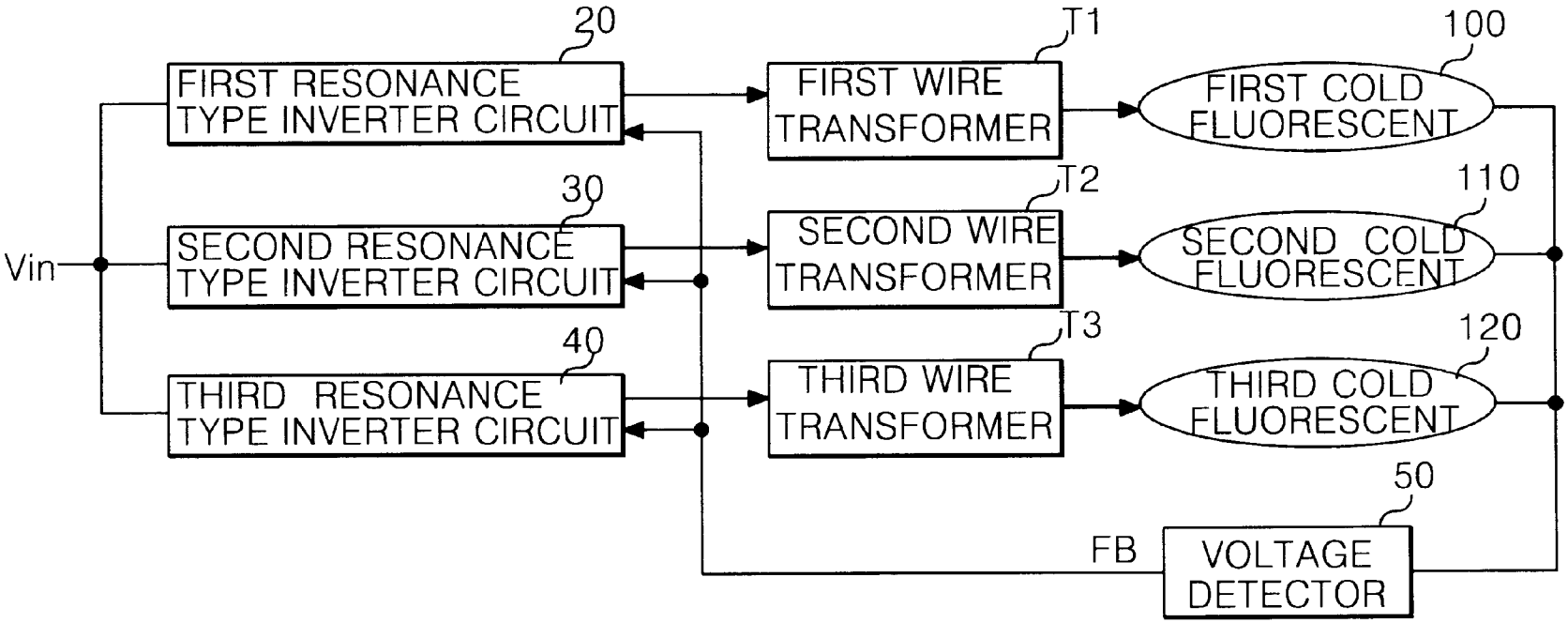
FIG.1 CONVENTIONAL ART
FIG. 1 is a block diagram representing a driving apparatus of a related art discharge tube lamp.
Figure 2:
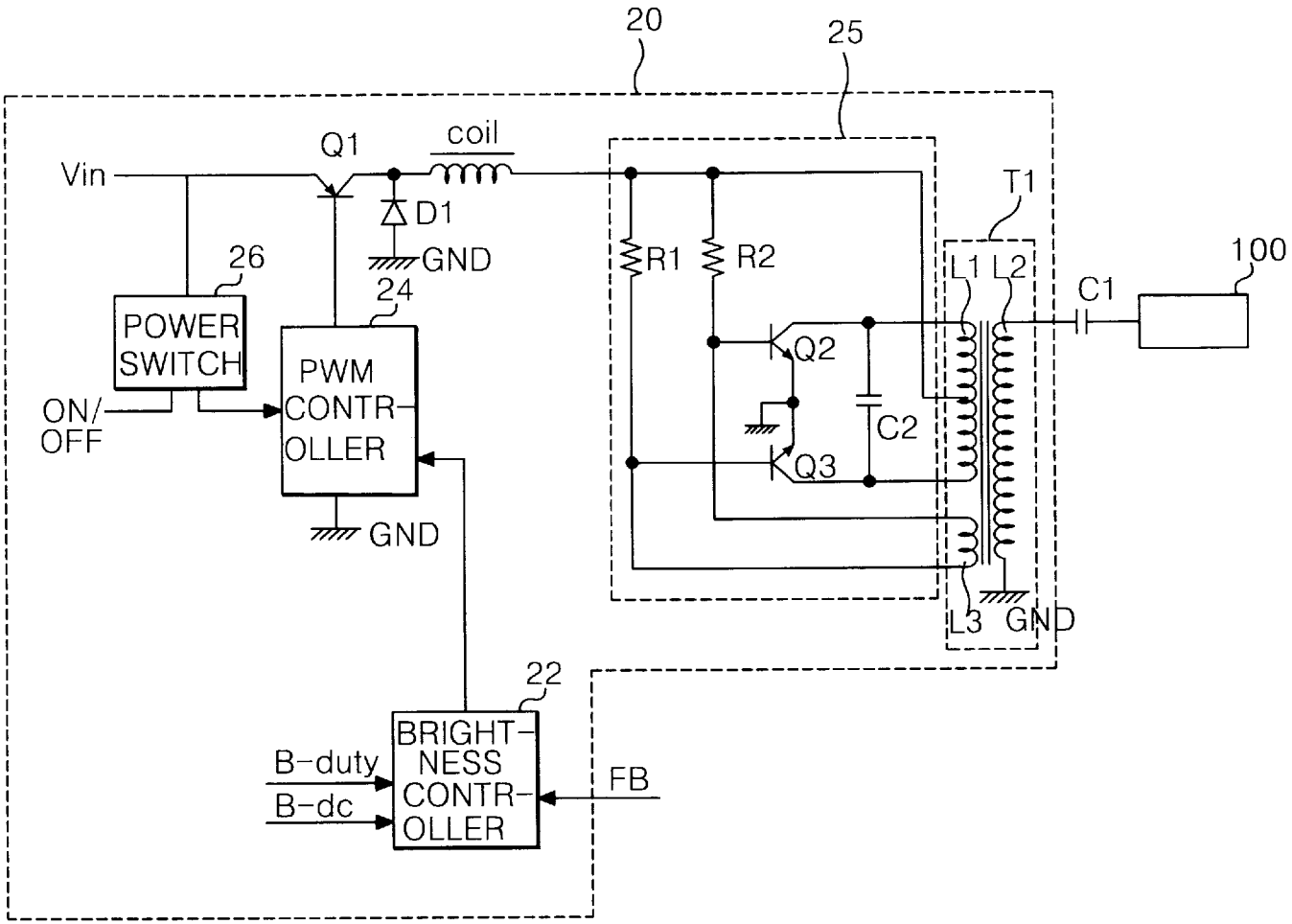
FIG.2 CONVENTIONAL ART
FIG. 2 is a circuit diagram particularly representing the resonance type inverter circuit shown in FIG. 1.
Figure 3:
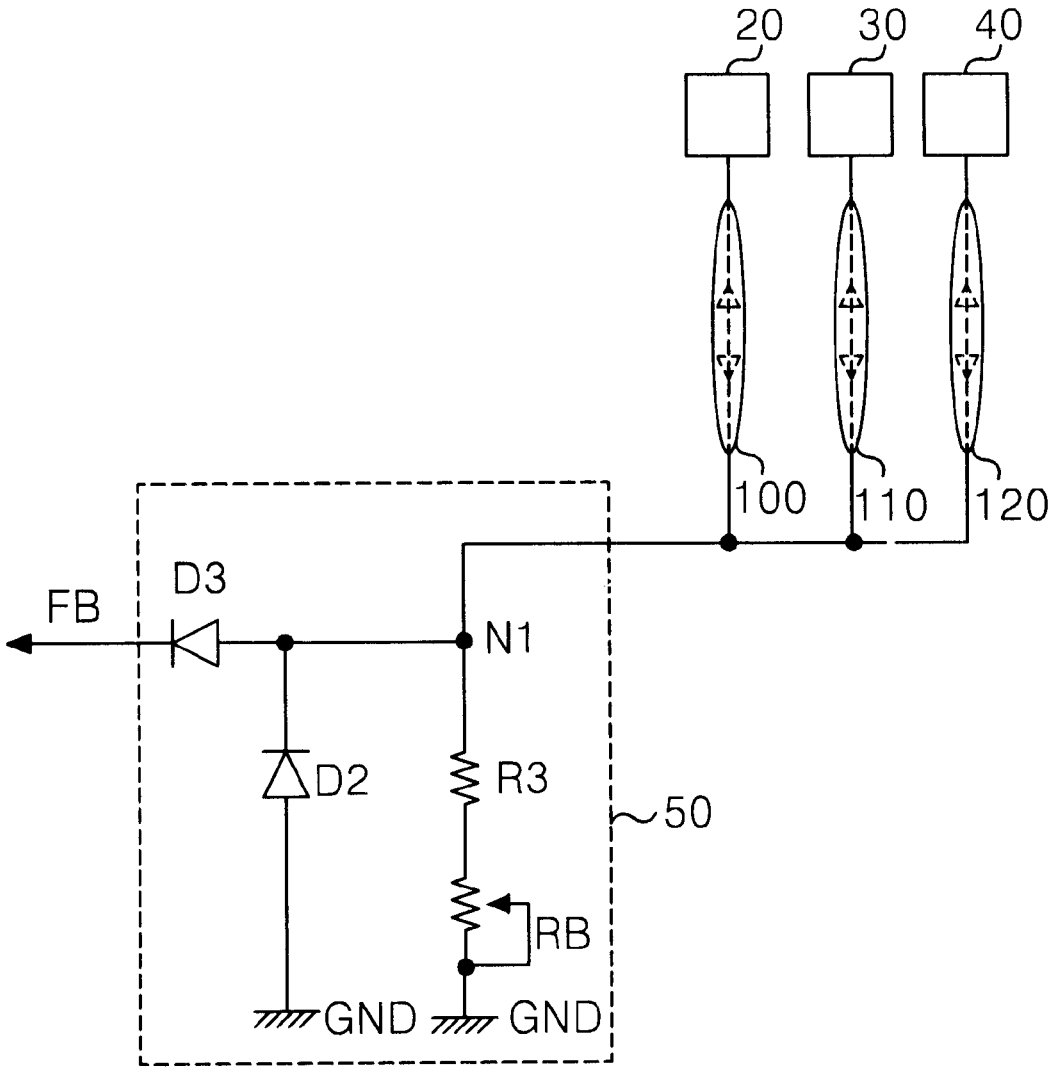
FIG.3 CONVENTIONAL ART
FIG. 3 is a circuit diagram particularly representing the voltage detector shown in FIG. 1.
Figure 4:
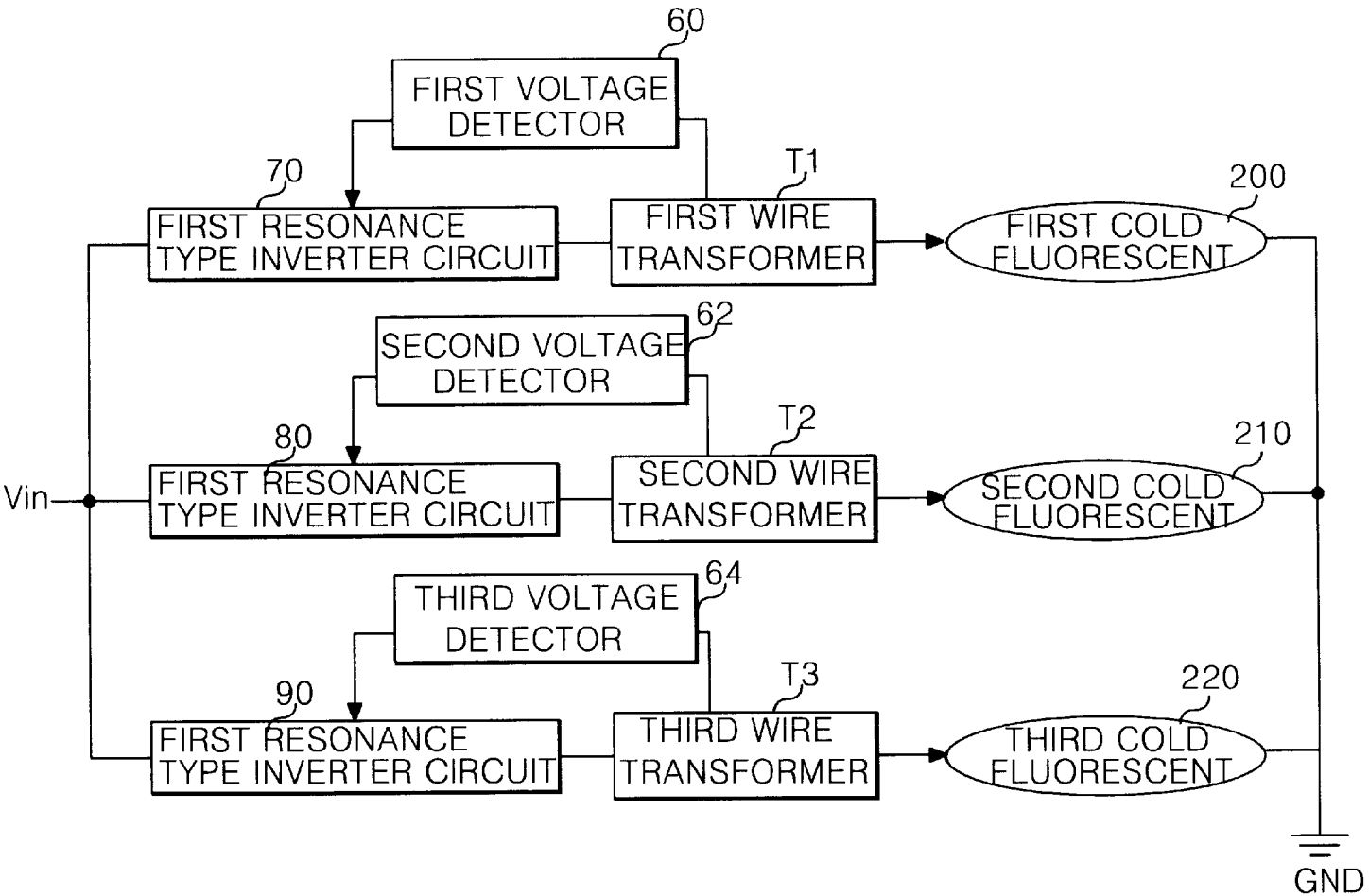
FIG. 4 is a block diagram representing a driving apparatus of a discharge tube lamp according to an embodiment of the present invention.
Figure 5:
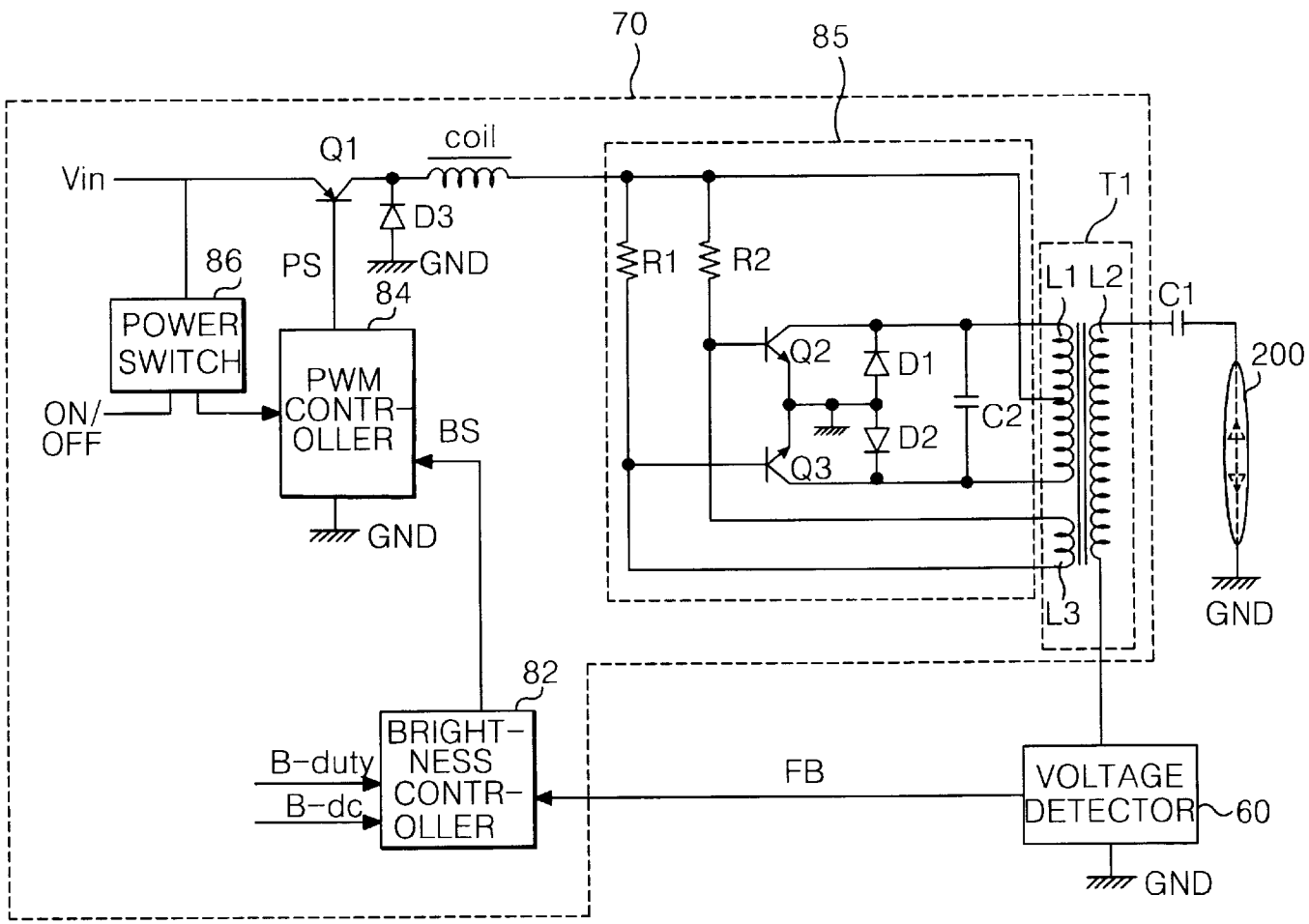
FIG. 5 is a circuit diagram particularly representing a driving apparatus of a discharge tube lamp according to an embodiment of the present invention.

Referring to FIGS. 4 and 5, a driving apparatus of a discharge tube lamp according to an embodiment of the present invention includes a voltage source Vin. First, second, and third CCFLs 200, 210 and 220 emit light by an AC signal. First, second and third resonance type inverter circuits 70, 80 and 90 are mounted between the voltage source Vin and the first to third CCFLs 200, 210 and 220 for supplying the AC signal to the first to third CCFLs 200, 210 and 220. First, second and third wire transformers T1, T2 and T3 boost the voltage supplied from the voltage source Vin and supply the boosted AC signal to the first the third CCFLs 200, 210 and 220. First, second and third voltage detectors 60, 62 and 64 are arranged between the first to third resonance type inverter circuits 70, 80 and 90, and the first to third wire transformers T1, T2 and T3 for detecting the voltage supplied to each of the first to third CCFLs 200, 210 and 220.

One terminal of each of the first to third CCFLs 200, 210 and 220 is connected to each of the first to third wire transformers T1, T2 and T3, respectively, and the other terminals are commonly connected to ground GND. Each of the first to third CCFLs 200, 210 and 220 receives the boosted AC signals from the first to third wire transformer T1, T2 and T3 to emit light.

Each of the first to third wire transformer T1, T2 and T3 may comprise a primary coil L1, a secondary coil L2 and an auxiliary coil L3. Each of the primary coil L1 and the auxiliary coil L3 is connected to a radio frequency oscillation circuit 85. One terminal of the secondary coil L2 is connected to one terminal of each of the first to third CCFLs 200, 210 and 220 through a first capacitor C1, and the other terminals are connected to each of the first to third voltage detectors 60, 62 and 64.

In the description that follows, only the first resonance type inverter circuit 70 is described because each of the first to third resonance type inverter circuits 70, 80 and 90 has the same circuit configuration.

The first resonance type inverter circuit 70 includes a radio frequency oscillation circuit 85 connected to the primary coil L1 of the first wire transformer T1. A first transistor Q1 is connected between the radio frequency oscillation circuit 85 and the voltage source Vin for switching the voltage from the voltage source Vin to the radio frequency oscillation circuit 85. A PWM controller 84 supplies a control signal to the first transistor Q1. A power switch 86 is connected between the PWM controller 84 and the voltage source Vin. A brightness controller 82 supplies a brightness control signal BS to the PWM controller 84 in accordance with the detected voltage signal BS supplied from the voltage detector 60.

The radio frequency oscillation circuit 85 includes a second transistor Q2 and a third transistor Q3 having the ground voltage source GND in between and connected to the primary coil L1 of the first wire transformer T1. A second capacitor C2 is arranged parallel to the primary coil L1. A first diode D1 and a second diode D2 have the ground voltage source GND in between and arranged between the output terminals of the second and third transistors Q2 and Q3.

The collector terminals of the second and third transistors Q2 and Q3 are respectively connected to both sides of the primary coil L1 of the first wire transformer T1. The emitter terminals are commonly connected to the ground voltage source GND. Also, the middle point of the primary coil L1 is connected to the base terminals of the second and third transistors Q2 and Q3 through a first R1 and a second resistance R2, and is connected to both sides of the auxiliary coil L3 of the first wire transformer T1.

The second and third transistors Q2 and Q3 are alternately switched to store at the second capacitor C2 the voltage supplied through the first transistor Q1.

The first diode D1 is arranged between the collector terminal of the second transistor Q2 and the ground voltage source GND in the direction toward the collector terminal of the second transistor Q2. The second diode D2 is arranged between the collector terminal of the third transistor Q3 and the ground voltage source GND in the direction toward the collector terminal of the third transistor Q3.

The first and second diodes D1 and D2 shut out a negative potential impulse generated upon the repeated switching of the second and third transistors Q2 and Q3. In other words, the first and second diodes D1 and D2 act as zero cross switches.

In the description that follows, only the first voltage detector 60 is described because each of the first to third voltage detectors 60, 62 and 64 has the same circuit configuration.

Figure 6:
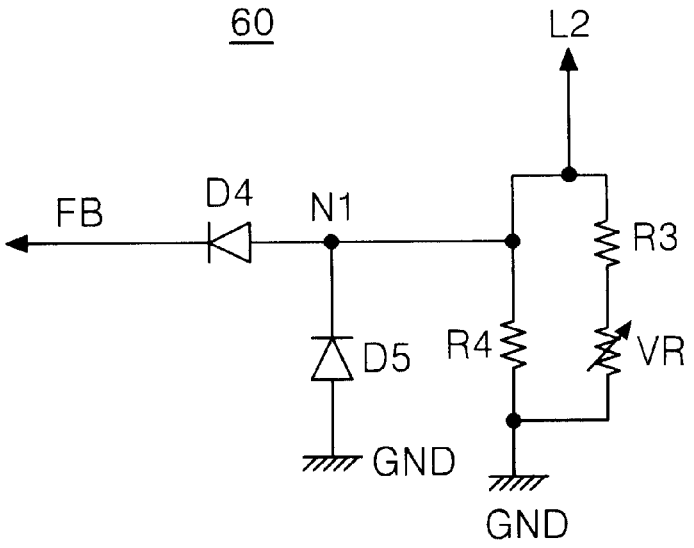
FIG. 6 is a circuit diagram particularly representing the voltage detector shown in FIG. 4.

Referring to FIG. 6, the first voltage detector 60 includes a third resistance R3 and a variable resistance VR serially connected between the ground voltage source GND and the secondary coil L2 of the first wire transformer T1. A fourth resistance R4 is connected parallel to the variable resistance VR and the third resistance R3. A fourth diode D4 is connected between the fourth resistance R4 and the brightness controller 82. A fifth diode D5 is connected between a first node N1 and the ground voltage source GND between the fourth diode D4 and the fourth resistance R4.

The first voltage detector 60 detects the AC high voltage induced on the secondary coil L2 of the first wire transformer T1 by the resistance value of the third resistance R3, the variable resistance VR and the fourth resistance R4. The detected voltage signal FB is rectified by the fourth diode D4 and supplied to the brightness controller 82.

The first to third voltage detectors 60, 62 and 64 detect the AC high voltages supplied to each of the first to third CCFLs 200, 210 and 220 from the first to third wire transformers T1, T2 and T3.

The brightness controller 82 generates a brightness control signal BS by using a brightness duty ratio signal B-duty or a reference brightness signal B-dc supplied from the outside and the detected voltage signal FB supplied from the voltage detector 60, and supplies the brightness control signal to the PWM controller 84. The brightness duty ratio signal B-duty and the reference brightness signal B-dc may be supplied by a system engineer or a user.

Figure 7:
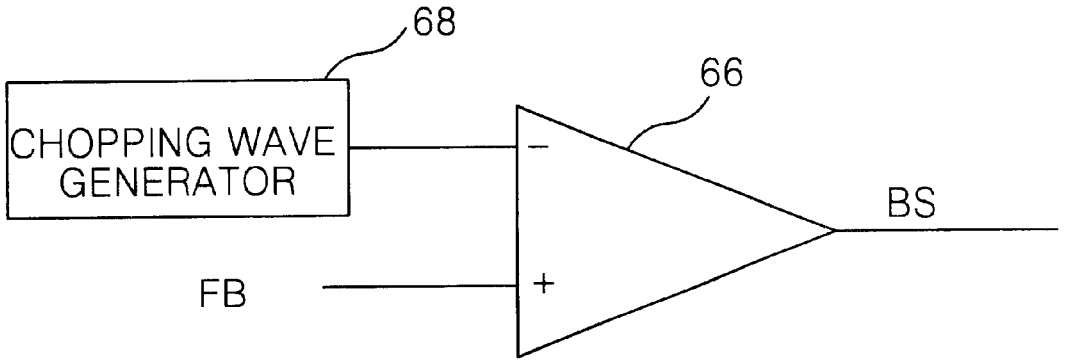
FIG. 7 is a diagram particularly representing the brightness controller shown in FIG. 4.

Referring to FIG. 7, the brightness controller 82 includes a chopping wave generator 68 for generating chopping waves. The brightness controller 82 also includes a comparator 66 having an inverted terminal (–) for receiving the chopping waves from the chopping wave generator 68 and a non-inverted terminal (+) for receiving the detected voltage signal FB from the voltage detector 60.

The chopping wave generator 68 generates the chopping waves by using a capacitor and a resistance (not shown) or by using any one of the brightness duty ratio signal B-duty or the reference brightness signal B-dc.

Figure 8A:
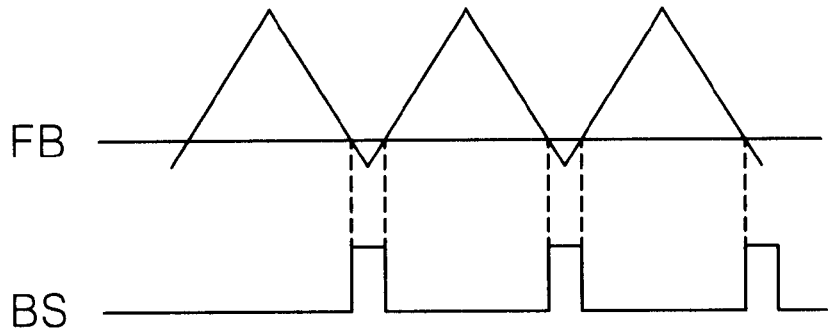
FIGS. 8A and 8B are waveform views representing a brightness control signal generated at the brightness controller shown in FIG. 4.
Figure 8B:
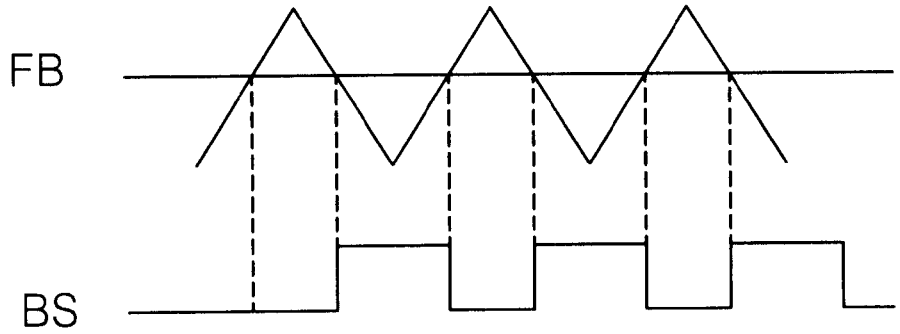

The comparator 66 generates the brightness control signal BS with a narrow pulse width by the detected voltage signal FB from the voltage detector 60, as shown in FIG. 8A. Also, the comparator 66 generates the brightness control signal BS with a wide pulse width by the detected voltage signal FB from the voltage detector 60, as shown in FIG. 8B. The pulse width of the brightness control signal BS is determined by the variable resistance VR value of the voltage detector 60.

PWM controller 84 receives the brightness control signal BS from the brightness controller 82 and supplies the PWM control signal to the base terminal of the first transistor Q1 when the power switch is turned on. The PWM control signal PS controls the switching cycle of the first transistor Q1 in accordance with the brightness control signal BS, thereby controlling the voltage supplied to the first wire transformer T1.

The first transistor Q1 is turned on by the PWM control signal PS supplied from the PWM controller 84 to switch to the radio frequency oscillation circuit 85 the voltage supplied from the voltage source Vin. A coil is connected between the collector terminal of the first transistor Q1 and the radio frequency oscillation circuit 85. The third diode D3 is connected between the collector terminal of the first transistor Q1 and the ground voltage source GND.

The coil prevents switching damage of the first transistor Q1 and determines a resonance frequency for a self-resonance with a radio frequency oscillation circuit 85. The third diode D3 sustains the lowest potential of the collector terminal of the first transistor Q1 at zero potential. In other words, the third diode D3 shuts out the impulse of the negative potential generated when turning off the first transistor Q1.

In such a CCFL driving apparatus, when the power switch 86 is turned on, the first transistor Q1 is turned on by the PWM control signal PS from the PWM controller 84 to supply driving power to the radio frequency oscillation circuit 85. At this moment, in the second and third transistors Q2 and Q3, turn-on/turn-off and turn-off/turn-on operations are carried out in accordance with the size of the voltage charged at the second capacitor C2 to induce an AC high voltage at the secondary coil L2 of each of the first to third wire transformers T1, T2 and T3.

Thus, the induced AC high voltage from the secondary coil L2 of each of the first to third wire transformers T1, T2 and T3 induces an AC high voltage at each auxiliary coil L3, due to this the second and third transistors Q2 and Q3 are repeatedly switched to continuously induce the AC high voltage at the secondary coil L2 of each of the first to third wire transformers T1, T2 and T3.

Therefore, each AC high voltage generated at the first to third wire transformers T1, T2 and T3 is supplied to each of the first to third CCFLs 200, 210 and 220 through the first capacitor Cl to turn on the first to third CCFLs 200, 210 and 220.

When the first to third CCFLs 200, 210 and 220 are turned on, the voltage signal FB is detected by each voltage detector 60 connected to the secondary coil L2 of each of the first to third wire transformers T1, T2 and T3.

The brightness control signal BS that controls the degree of the brightness of each of the first to third CCFLs 200, 210 and 220 is generated in the brightness controller 82 in accordance with the detected voltage signal FB. And, the switching of the first transistor Q1 is controlled at the PWM controller 84 to regulate the voltage supplied to the primary coil L1 of each of the first to third wire transformers T1, T2 and T3, in accordance with the brightness control signal BS generated. Accordingly, the electric current supplied to each of the first to third CCFLs 200, 210 and 220 is regulated through the secondary coil L2 of each of the first to third wire transformer T1, T2 and T3.

Therefore, the driving apparatus of the CCFL lamp detects the voltage through the first to third voltage detectors 60, 62 and 64 connected to the secondary coil L2 of each of the first to third wire transformers T1, T2 and T3, and controls individually the current supplied to each of the first to third CCFLs 200, 210 and 220. Thereby, the brightness deviation of a plurality of cold cathode fluorescent tubes can be made to be uniform.

As described above, the driving apparatus of the discharge tube lamp according to the present invention has one terminal of a plurality of cold cathode fluorescent tubes commonly connected to the ground voltage source, and detects the voltage flowing through the secondary coil of a wire transformer such that the electric current flowing in each of a plurality of CCFLs is controlled individually, thereby making the brightness deviation of a plurality of the CCFLs uniform and thereby improving the life time of the CCFLs.

It will be apparent to those skilled in the art that various modifications and variations can be made in the driving apparatus of a discharge tube lamp of the present invention without departing from the spirit or scope of the invention. Thus, it is intended that the present invention cover the modifications and variations of this invention provided they come within the scope of the appended claims and their equivalents.

What is claimed is:

1. A driving apparatus of a discharge tube lamp, comprising:

a voltage source;

a plurality of AC conversion circuits for boosting a voltage supplied from the voltage source and generating a plurality of boosted AC signals;

a plurality of discharge tubes for receiving the boosted AC signals and emitting a plurality of lights;

a plurality of detection circuits arranged between each of the plurality of AC conversion circuits and a ground voltage source for detecting a voltage supplied to each of the plurality of discharge tubes; and a controller arranged between the voltage source and each of the plurality of the AC conversion circuits for controlling the voltage supplied to the plurality of AC conversion circuits in accordance with a plurality of detection signals supplied from the plurality of detection circuits.

2. The driving apparatus of the discharge tube lamp according to claim 1, wherein each of the plurality of AC conversion circuits includes:

a primary coil and an auxiliary coil connected to the voltage source; and a secondary coil connected to a discharge tube and a detection circuit.

3. The driving apparatus of the discharge tube lamp according to claim 1, wherein the controller includes:

a first switch arranged between an AC conversion circuit and the voltage source for switching the voltage from the voltage source to the AC conversion circuit in accordance with a switching control signal;

an oscillation circuit arranged between the first switch and the AC conversion circuit for supplying an AC signal to the AC conversion circuit in accordance with a switching operation;

a brightness controller for generating a brightness control signal in accordance with a detection signal supplied from a detection circuit; and a pulse width controller for supplying to the first switch the switching control signal that controls the voltage supplied to the oscillation circuit in accordance with the brightness control signal supplied from the brightness controller.

4. The driving apparatus of the discharge tube lamp according to claim 3, wherein the oscillation circuit includes:

a second switch and a third switch connected between the ground voltage source and the primary coil of the AC conversion circuit;

a capacitor connected between the output terminals of the second switch and the third switch; and a first diode and a second diode connected between the output terminals of the second switch and the third switch having the ground voltage source in between.

5. The driving apparatus of the discharge tube lamp according to claim 3, wherein the detection circuit includes:

a variable resistance connected to the secondary coil of the AC conversion circuit;

a first resistance connected between the variable resistance and the ground voltage source; and a first diode mounted between the brightness controller and a node being between the variable resistance and the first resistance.

6. The driving apparatus of the discharge tube lamp according to claim 5, wherein the detection circuit further includes a second resistance arranged in parallel to the variable resistance and the first resistance.

7. The driving apparatus of the discharge tube lamp according to claim 5, wherein the detection circuit further includes a second diode arranged between the first diode and the ground voltage source.

* * * * *